United States Patent [19]

Tokita et al.

[11] 4,385,256

[45] May 24, 1983

[54] COLOR PICTURE TUBE PROVIDED WITH AN INNER MAGNETIC SHIELD

[75] Inventors: Kiyoshi Tokita, Fukaya; Toshiaki Kanemitsu, Hyogo, both of Japan

[73] Assignee: Tokyo Shibaura Denki Kabushiki Kaisha, Kawasaki, Japan

[21] Appl. No.: 254,492

[22] Filed: Apr. 15, 1981

[30] Foreign Application Priority Data

Apr. 17, 1980 [JP] Japan ..... 55-49583
Apr. 17, 1980 [JP] Japan ..... 55-49584

[51] Int. Cl.[3] ..... H01J 29/06

[52] U.S. Cl. ..... 313/407; 313/479; 315/85

[58] Field of Search ..... 313/407, 479; 315/8, 315/85

[56] References Cited

U.S. PATENT DOCUMENTS 4,019,085 4/1977 Sakata ..... 313/479 X
4,229,675 10/1980 Matsuki et al. ..... 315/85 X
4,274,031 6/1981 Saito ..... 313/407

*Primary Examiner*—Palmer C. Demeo
*Attorney, Agent, or Firm*—Cushman, Darby & Cushman

[57] ABSTRACT

An inner shield made of a magnetic material for shielding the earth magnetism is provided in a color picture tube for preventing the mislanding of the electron beams on phosphor stripes that might otherwise result from the bending of the electron beams caused by the earth magnetism. The inner shield is formed by securing a pair of short side sections and a pair of long side sections to a mask frame such as to define a substantially rectangular space through which the electron beams pass. Gaps offering increased magnetic reluctance are provided between the short side sections on one hand and the long side sections on the other hand, whereby the components of the horizontal earth magnetic field vector are adjusted to cancel electromagnetic forces acting upon the electron beams.

7 Claims, 13 Drawing Figures

COLOR PICTURE TUBE PROVIDED WITH AN INNER MAGNETIC SHIELD

This invention relates to color picture tube provided with an inner magnetic shield.

It is well known in the art that in a color picture tube the electron beams produced from the electron gun assembly are bent by the earth magnetism, particularly, mislanding of the electron beams is caused near the corners of the face plate, thus deteriorating the color purity. Accordingly, in the prior art color picture tube a magnetic shield is provided along a portion of the tube inner surface corresponding to the space through which the electron beams pass. The provision of the magnetic shield along the inner tube surface, however, increases the weight and cost of the tube itself. To solve this problem, an inner shield having a structure, in which the short sides thereof corresponding to the short side inner surface portions of the color picture tube are partly removed, has been proposed as disclosed in Japanese Utility Model Publication No. 36928/1980 published on Aug. 30, 1980. Where such an inner shield with the short sides partly removed is used, however, the electron beams are comparatively displaced by the earth magnetism when the face plate of the picture tube is directed to the East or West, and in the extreme case the mislanding is prone to deteriorate the color purity.

An object of the invention is to provide a color picture tube provided with an inner shield which can prevent or minimize the mislanding of the electron beams, particularly at the corners of the face plate, due to the earth magnetism.

According to the invention, there is provided a color picture tube, which comprises phosphor stripes provided on the face plate in a regular arrangement and an inner shield made of a magnetic material and provided at the four corners with portions of increased magnetic reluctance. The increased magnetic reluctance portions correspond in locality to the four corners of the face plate where mislanding of the electron beams is most liable to result, and in one embodiment of the invention they are gaps. When the face plate is directed to the North or South, the horizontal components of earth magnetic force lines perpendicular to the face plate of the color picture tube in the neighborhood of the inner shield are bent theretoward and concentrated thereinto. Therefore, in the neighborhood of the inner shield, a first subcomponent directed in the direction parallel to the tube axis, a second subcomponent directed in the direction perpendicular to the first subcomponent and substantially parallel to the phosphor stripes and a third subcomponent directed in the direction perpendicular to the first and second subcomponents are produced from the horizontal component of the earth magnetic field. The first, second and third subcomponents produced in the space adjacent to the four corners of the inner shield can be adjusted by adjusting the width and shape of the magnetic reluctance portions, and in effect the magnitude of the electromagnetic forces acting upon the electron beam can be adjusted for preventing the mislanding thereof.

This invention can be more fully understood from the following detailed description when taken in conjunction with the accompanying drawings, in which.

Figure 1:
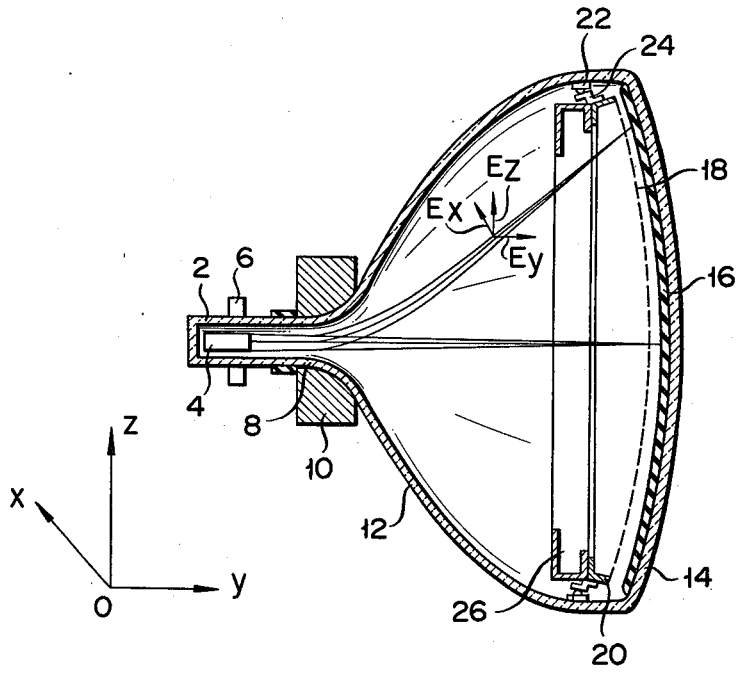
FIG. 1 is a schematic sectional view showing an embodiment of the color picture tube according to the invention.

Referring to FIG. 1, an embodiment of the color picture tube according to the invention is shown. As is well known in the art, an electron gun assembly 4 for producing three electron beams is received in a neck 2 of the color picture tube, and an adjustment member 6 including a color purity magnet and a convergence yoke are provided on the outer periphery of the neck 2. A deflection yoke 10 for deflecting the electron beams is secured to the outer periphery of an yoke section 8 of the tube extending from the neck 2. A funnel section 12 extending from the yoke section 8 has its front opening hermetically sealed with a face plate 14, thus forming a color picture tube envelope which is held evacuated. Provided on the inner surface of the face plate 14 is a phosphor layer, which is constituted by a number of red, green and blue phosphor stripes respectively emitting red, green and blue light when corresponding electron beams are landed on them, these phosphor stripes being in a parallel and regular arrangement. A shadow mask 18 provided with a number of regularly arranged apertures or slits is disposed to face the inner surface of the face plate 14. The shadow mask 18 is supported in a substantially rectangular mask frame 20, which is in turn fixed to the face plate 12 via a spring 24 secured to pannel pins 20 part of which are embedded in the face plate 24.

Figure 2:
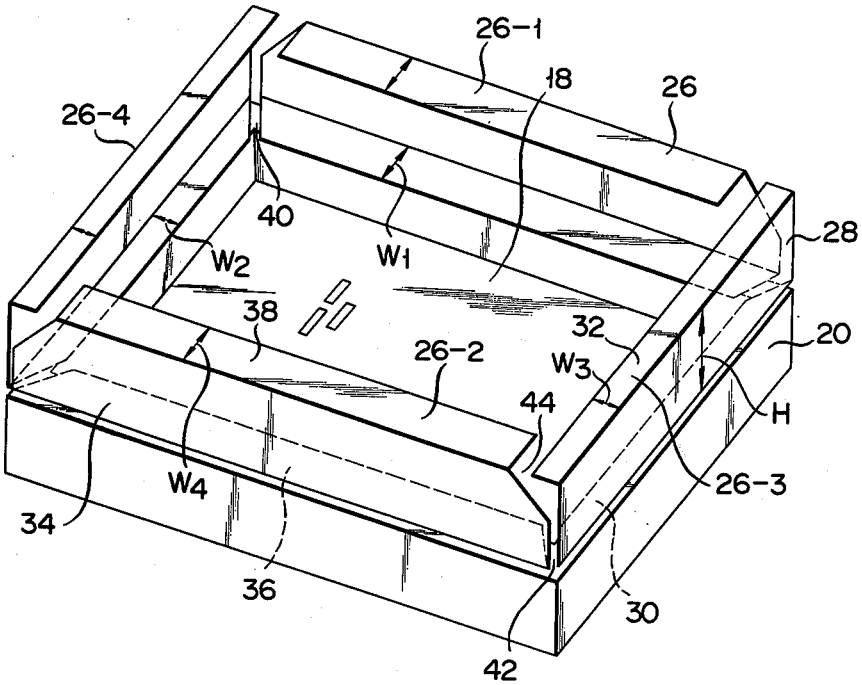
FIG. 2 is a perspective view showing an example of the inner shield assembled in the color picture tube shown in FIG. 1.
Figure 3:
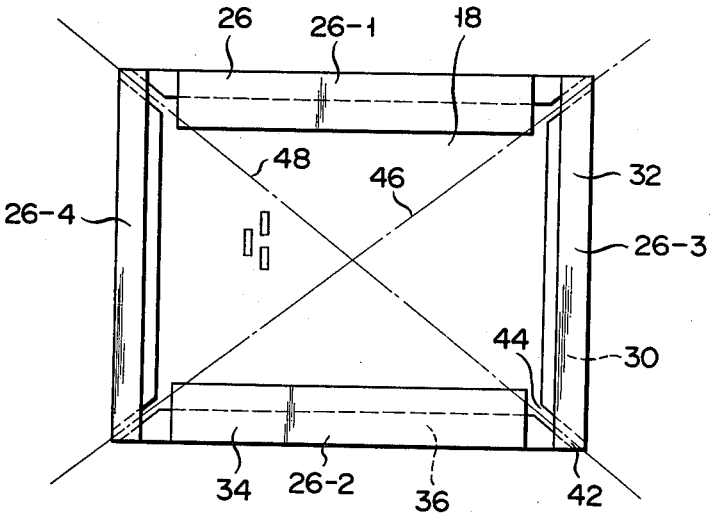
FIG. 3 is a plan view showing the inner shield shown in FIG. 2.

To the mask frame 20 is secured an inner shield 26 which is made of a magnetic material, preferably a ferro-magnetic material, as shown in FIGS. 2 and 3. The inner shield 26 is constituted by two long side sections 26-1 and 26-2 having substantially the same shape and corresponding to the long sides of the rectangular mask frame 20 and two short side sections 26-3 and 26-4 also having substantially the same shape and corresponding to the short sides of the mask frame 20. The short side sections 26-3 and 26-4 are each formed from a magnetic plate by bending opposite edge portions thereof, and they each have a side portion 28 and front and rear portions 30 and 32 extending from the side portion 28 substantially at right angles thereto and in the same direction. Likewise, the long side sections 26-1 and 26-2 are each formed from a magnetic plate by bending opposite edge portions thereof, and they each have a side portion 34 and front and rear portions 36 and 38 extending from the side portion 38 substantially at right angles thereto and in the same direction. The side portions 28 and 34 of the long and short side sections 26-1, 26-2, 26-3 and 26-4 substantially have the same height H, but the widths $W_1$, $W_2$, $W_3$ and $W_4$ of the rear and front portions 30, 32, 36 and 38 are set to appropriate values as will be described hereinafter. As is shown in the Figures, the front portions 30 and 36 of the short and long side sections are secured to a rear supporting face 40 of the mask frame 20, with first gaps 42 provided between the side portions 34 of the long side section 26-1 and 26-2 on one hand and the corresponding side portions 28 of the short side sections 26-3 and 26-4 on the other hand and second gaps 44 provided between the rear portions 38 of the long side sections 26-1 and 26-2 on one hand and the corresponding rear portions 32 of the short side sections 26-3 and 26-4 on the other hand. As shown in FIG. 3, the first and second gaps 42 and 44 are found on the diagonals of the mask frame 26, i.e., on the diagonals 46 and 48 of the face plate 14, and the second gaps 44 extend substantially parallel to the short sides of the face plate 14. In any event, the first and second gaps 42 and 44 are provided substantially on the four corners of the face plate 14.

With the inner shield 26 consisting of the four sections 26-1 to 26-4 provided inside the funnel section 12 near the shadow mask 18 such as to surround an electron beam passage space and the gaps 42 and 44 provided in the inner shield 26 at portions thereof corresponding to the four corners of the face plate 14, the mislanding of the electron beams that may otherwise be caused as they are greatly bent by the earth magnetism can be prevented under the following principles.

The electron beams emitted from the electron gun 4 are deflected by the deflection yoke 10 as they proceed therethrough to be directed through the space in the funnel section 12 toward the shadow mask 18, and after passing through the slits or apertures of the shadow mask 18 they land on corresponding phosphor stripes of the phosphor layer 16. The extent to which the electron beams are bent by the earth magnetism acting upon these electron beams at various passing points within the funnel section 12 is smaller for electron beams proceeding in directions closer to the center of the shadow mask 18 and is greater for electron beams proceeding in directions closer to the four corners of the shadow mask 18. Also, it is greater in the electron beams passing area closer to the shadow mask 18 and is smaller in the electron beam passing area closer to the deflection yoke 10. Thus, the inner shield 26 need not magnetically shield the entire inner surface of the funnel section 12 but is required to magnetically shield only the inner surface of the funnel section 12 close to the shadow mask 18.

Figure 4:
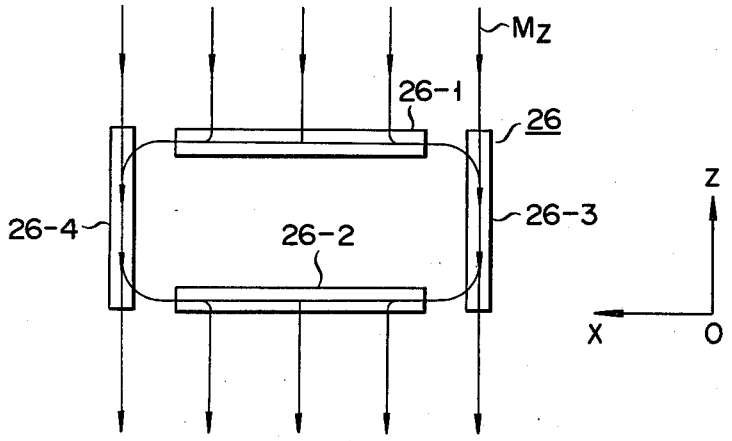
FIG. 4 is a view illustrating the function of the inner shield with respect to vertical earth magnetic force lines.
Figure 5:
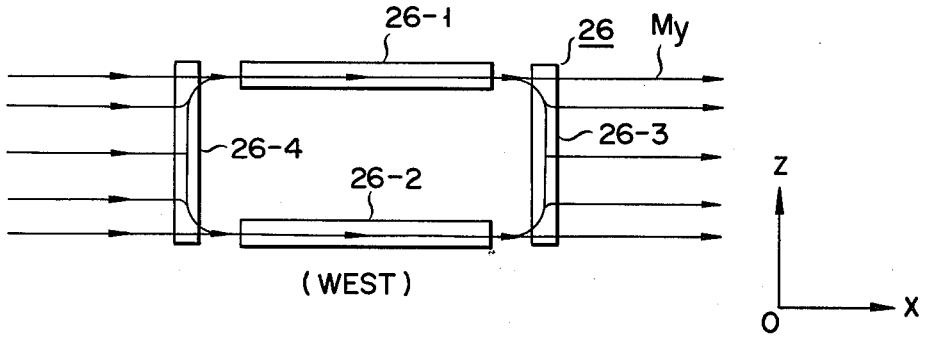
FIGS. 5 and 6 are views illustrating the function of the inner shield viewed from an electron gun assembly with respect to horizontal earth magnetic force lines when the face plate of the color picture tube is directed to the West and East respectively.
Figure 6:
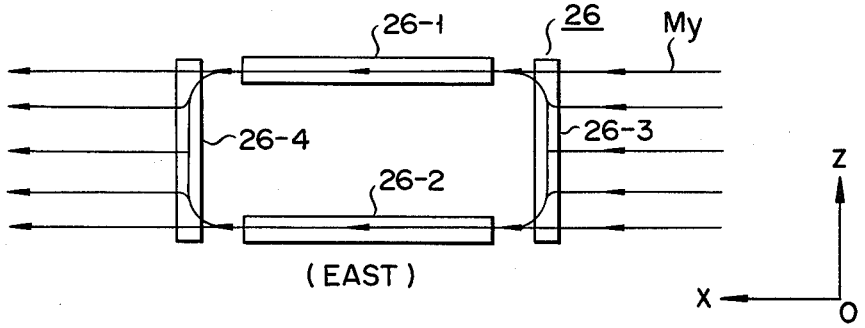

The magnetic force lines of the earth magnetism extending from the South pole to the North pole are parallel to the earth surface substantially on the equator while at the South and North poles they are substantially perpendicular to the earth surface. In areas between the equator and each pole, they are inclined with respect to the earth surface and have vertical and holizontal components $M_z$ and $M_y$ perpendicular and parallel to the earth surface respectively. The electron beams deflected by the deflection yoke 10 has a current component $E_y$ extending in the direction y of the tube axis, a current component $E_x$ extending in the direction x parallel to the long side of the face plate 14 and perpendicular to the direction y and a current component $E_z$ extending in the direction z parallel to the short side of the face plate 14 and perpendicular to the directions x and y. The vertical components $M_z$ of earth magnetic field vectors are concentrated into the inner shield 26 and pass therethrough, and they hardly pass through the space enclosed within the inner shield 26 as shown in FIG. 4. Thus, within the inner shield 26 the electron beams are rarely displaced by the vertical component $M_z$ of the earth magnetism. While the electron beams are displaced by the vertical component $M_z$ of the earth magnetism during their travel through the space within the funnel section 12 between the inner shield 26 and deflection yoke 10, the displacement is not so great as to cause mislanding of the electron beams. Thus, with the inner shield 26 shown in FIG. 2, it is possible to provide shielding against the vertical component $M_z$ of the earth magnetism to such an extent as to prevent the mislanding of the electron beams. When the face plate 16 is directed to the West, the horizontal components $M_y$ of earth magnetism vectors are concentrated into the inner shield 26 and pass therethrough as shown in FIG. 5. When the face plate 16 is directed to the East, the horizontal components $M_y$ of the earth magnetism vectors are also concentrated into the inner shield 26 and pass therethrough as shown in FIG. 6. Thus, in either case when the face plate 16 is directed to the West or to the East, no horizontal component of the earth magnetism passes through the space inside the inner shield 26, and the electron beams passing through this space are not displaced by the horizontal component $M_y$. While the horizontal component $M_y$ of the earth magnetism passes through the space within the funnel section 12 between the inner shield 26 and deflection yoke 10, the electron beams are not displaced by this horizontal component $M_y$ so much as to cause their mislanding.

Figure 7:
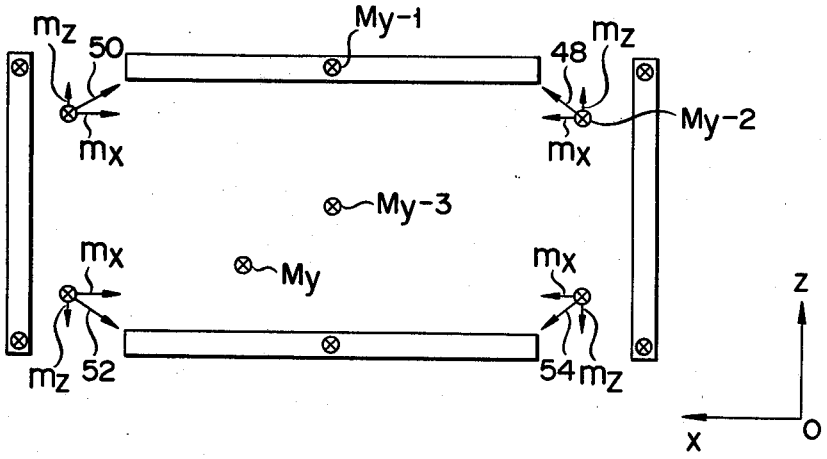
FIGS. 7, 8 and 9 are views illustrating the function of the inner shield with respect to horizontal earth magnetic force lines when the face plate of the color picture tube is directed to the North, the inner shield shown in FIGS. 7 and 9 being viewed from an electron gun assembly.
Figure 8:
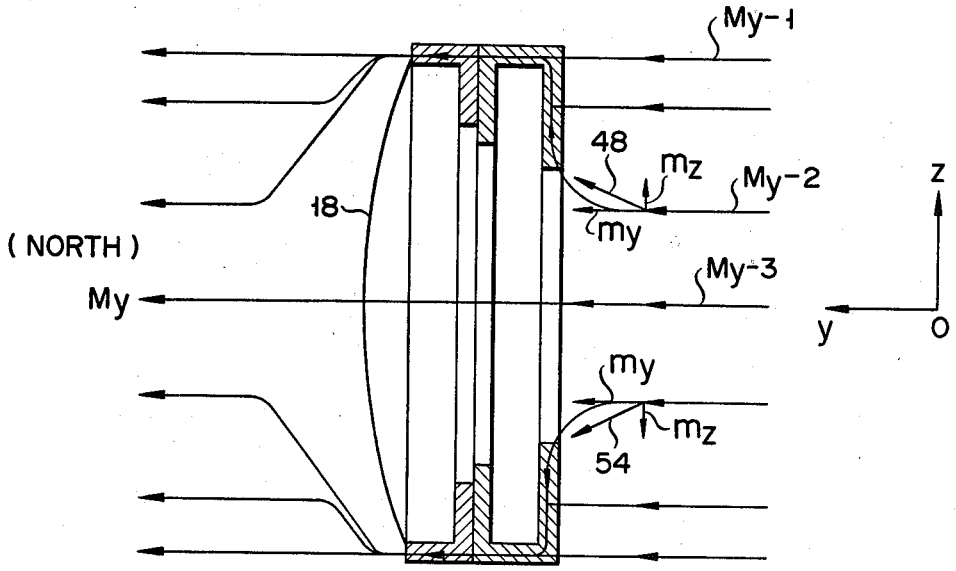
Figure 9:
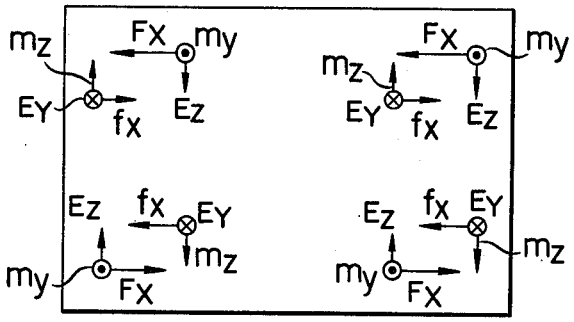

When the face plate 16 is directed to the North, the distribution of the horizontal components $M_y$ of earth magnetism vectors are not so simple as when the face plate 16 is directed to the East or to the West; in this case, as shown in FIGS. 7 and 8, some horizontal components $M_{y-1}$, $M_{y-2}$ enters into the inner shield 26 while other components $M_{y-3}$ pass through the space inside the inner shield 26. The electron beams are hardly displaced by the horizontal components $M_{y-3}$ passing through the central zone of the space inside the inner field 26. This is because of the fact that the current component $E_y$ of the electron beams passing through the central zone in a direction y is great while its z and x directional current components $E_z$ and $E_x$ are small so that no external force F is exerted to the electron beams as is obvious from the Fleming's left hand law. The electron beams are also not displaced by the horizontal components $M_{y-1}$ that pass straight through the inner shield 26. This is because the electron beams are not deflected by the deflection yoke 10 up to the area where the horizontal components $M_{y-1}$ are present. However, in the space close to the inner surface of the inner shield 26, particularly to the corners thereof, the horizontal components $M_{y-2}$ are bent toward the inner shield 26 as shown at 48, 50, 52 and 54 in FIGS. 7 and 8. In other words, in this space components 48, 50, 52 and 54 each having x, y and z field subcomponents $m_x$, $m_y$ and $m_z$ are produced. As is apparent from the Figure, the components 48 and 52 individually have mutually opposite field subcomponents $m_x$ and $m_z$ and also the components 50 and 54 individually have mutually opposite field subcomponents $m_x$ and $m_z$. On the other hand, the electron beams passing through the space close to the corners of the inner shield 26 have not only the y current component $E_y$ but also comparatively large x and z current components $E_x$ and $E_z$. Thus, forces $f_x$ and $F_x$ are exerted to the electron beams according to the Fleming's law as shown in FIG. 9. While in FIG. 9 the forces $f_x$ and $F_x$ are shown to be exerted to different points for the sake of the clarity of the illustration, actually they all act upon the same electron beam. Although not shown in FIG. 9, the forces $F_y$, $F_z$, $f_y$ and $f_z$ are produced by the current vectors $E_x$, $E_y$ and $E_z$ and field vectors $m_x$, $m_y$ and $m_z$. The forces $f_y$ and $F_y$ are directed in the direction of the tube axis, so that they are not effective to cause mislanding of the electron beams. Also, the forces $f_z$ and $F_z$ are directed in the direction parallel to the phosphor stripes and are thus ineffective to cause mislanding of the electron beams. If the force vectors $f_x$ and $F_x$ are equal in the scalar, they cancel each other, and in this case the mislanding of the electron beams will not result. According to the invention, high magnetic reluctance portions, i.e., gaps 42 and 44, are provided at the four corners of the inner shield 26. Thus, the proportions of the scalars of the field subcomponents $m_x$, $m_y$ and $m_z$ of the vectors 48, 50, 52 and 54 that are obtained from the horizontal magnetic field components $M_{y-2}$ passing through the space near the four corners may be suitably selected by appropriately setting the gaps 42 and 44. More particularly, by increasing the gaps 42 and 44 the subcomponent $m_x$ and $m_y$ are reduced while the subcomponent $m_x$ is increased. On the other hand, by reducing the gaps 42 and 44 the subcomponents $m_x$ and $m_y$ are increased while the subcomponent $m_z$ are reduced. Thus, by suitably selecting the proportions of the components $m_y$ and $m_z$, the magnitudes of the forces $f_x$ and $F_x$ may be made equal to prevent the mislanding and improve the color purity at the corners of the face plate 14.

Figure 10:
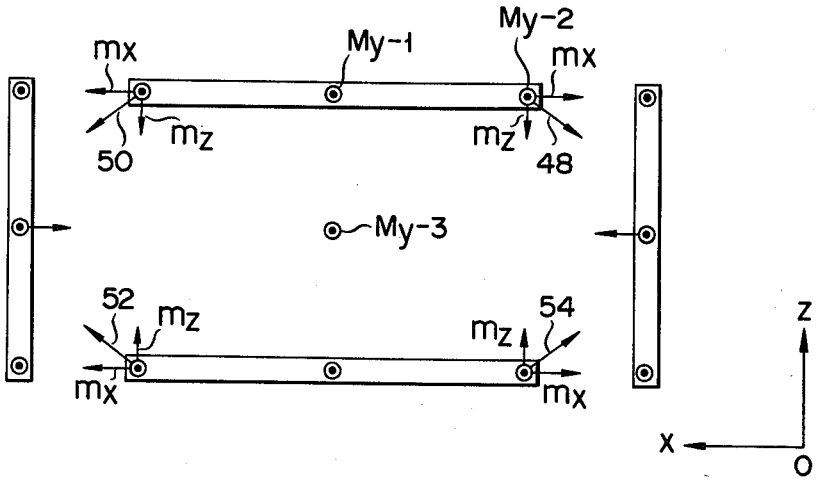
FIGS. 10, 11 and 12 are views illustrating the function of the inner shield with respect to horizontal earth magnetic force lines when the face plate of the color picture tube is directed to the South, the inner shield shown in FIGS. 7 and 9 being viewed from an electron gun assembly.
Figure 11:
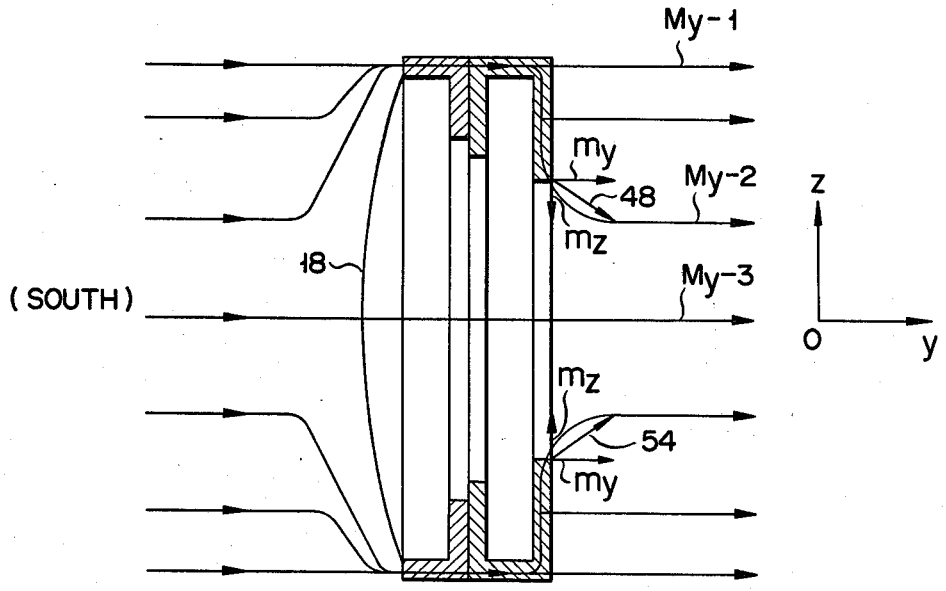
Figure 12:
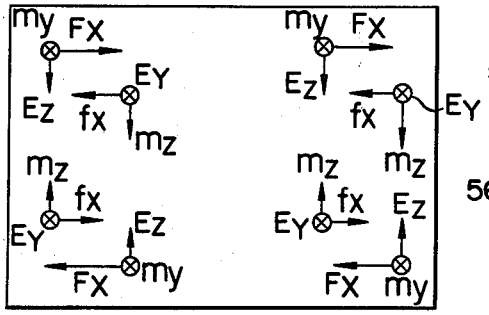

While the above description has been made in connection with the case when the face plate 16 is directed to the North, the same applies to the case when the face plate 16 is directed to the South. This case is illustrated in FIGS. 10 to 12. In FIGS. 7 to 12 like vectors and components are designated by like reference symbols.

With a 14-inch 90° deflection color picture tube using the inner shield 26 shown in FIG. 2, in which the height H of the side sections 28 and 34 is set to 20 mm, the width $W_4$ of the rear portion 34 of the long side section is set to 25 mm, the width $W_3$ of the rear portion 32 of the short side section is set to 15 mm and the width of the gaps 42 and 44 is set to 5 mm, the electron beams were displaced substantially by 17.5 microns when the face plate 14 was directed from the South to the North and also turned the same amount when the face plate 14 was directed from the east to the west. This value of displacement was sufficiently small to prevent the mislanding. Also, the displacement was small and equal when the direction of the face plate was changed.

As has been shown, by providing the gaps 42 and 44 in the inner shield 26, it is possible to adjust the electromagnetic force acting upon the electron beams due to the horizontal component of the earth magnetic field. Also, by suitably selecting the width $W_3$ of the rear portion 32 of the short side section, it is possible to shield the electron beams against leakage through the gaps 42. Further, by suitably selecting the widths $W_3$ and $W_4$ of the rear portions 32 and 38 of the long and short side sections, it is possible to the landing of overdeflected electron beams upon phosphor strips. Still further, by suitably selecting the widths $W_1$ and $W_2$ of the front portions 36 and 30, it is possible to shield unnecessary electron beams adjacent to the effective electron beams, that is, the landing area on the phosphor layer 16 can be defined by the front portions 36 and 30. Furthermore, by suitably selecting the height H of the side portions 28 and 34, it is possible to prevent the electron beams from being reflected between the front and rear portions 30, 32, 36 and 38 of the inner shield 26. In other words, the inner shield 26 may be provided with not only the function as a magnetic shield but also the function as an electron shield.

Figure 13:
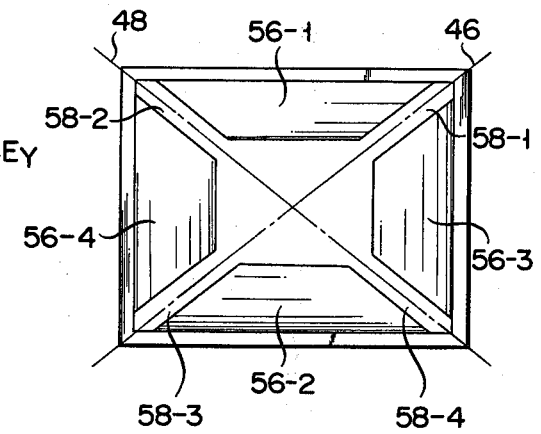
FIG. 13 is a plan view showing an inner shield viewed from an electron gun assembly in a different embodiment of the invention.

FIG. 13 shows a different embodiment of the inner shield 56 according to the invention. This inner shield 56 is not box-like in shape as shown in FIG. 2, but has a substantially trapezoidal sectional profile. Like the shield shown in FIG. 2, this inner shield 56 includes four sections 56-1, 56-2, 56-3 and 56-4, and gaps 58-1, 58-2, 58-3 and 58-4 are defined by these sections. These individual sections of the inner shield 56 extend along the inner surface of the funnel sections 12, so that they have a substantially trapezoidal sectional profile. The gaps 58-1 to 58-4 are all provided to be found on the diagonals of the face plate 16 to minimize the effect of the earth magnetism as mentioned earlier. Particularly, with this embodiment not only the magnetic field passing through the space inside the funnel section 12 in the neighborhood of the shadow mask 18 but also the magnetic field passing through the space in the neighborhood of the deflection yoke 10 can be shielded.

While in the above embodiments the gaps have been provided as high magnetic reluctance zones at the four corners of the inner shield, these gaps may be replaced with non-magnetic members. In the case of providing the gaps, however, the inner shield can be assembled from four sections, and in this case it is possible to improve the efficiency of manufacture of the inner shield and reduce the cost thereof.

What we claim is:

1. A color picture tube comprising:

a vacuum envelope including a substantially rectangular face plate, a funnel section, a yoke section and a neck section;

a phosphor layer including a number of phosphor stripes formed on the inner surface of said face plate in a regular arrangement;

a substantially rectangular shadow mask provided within said vacuum envelope to face the inner surface of the face plate and provided with a number of slits individually corresponding to said respective phosphor stripes;

an electron gun assembly provided within said neck for producing electron beams to be landed on the phosphor stripes of the face plate through the slits of said shadow mask;

a deflection yoke provided on the outer periphery of said yoke section for deflecting the electron beams produced from said electron gun assembly; and inner shield means provided within said envelope in the proximity of said shadow mask and having an opening for passing the electron beams, said inner shield means being made of a magnetic material and having corner portions which corresponds to the four corners of said face plate and each of which magnetic reluctance is higher than that of the other portions.

2. A color picture tube according to claim 1, wherein said inner shield means includes a pair of short side sections and a pair of long side sections, said sections being arranged to form the rectangular opening, the corner portions being provided between said short side sections on one hand and said long side sections on the other hand.

3. A color picture tube according to claim 2, wherein the corner portions are gaps.

4. A color picture tube according to claim 2, wherein each said section is constituted by a flat magnetic plate and extends along the inner surface of said funnel section.

5. A color picture tube according to claim 2, wherein said four sections and shadow mask are secured to a mask frame secured to said vacuum envelope.

6. A color picture tube according to claim 2, wherein said sections are each formed by bending the magnetic plate into a substantially L-shaped form, the substantially rectangular opening being defined by the bent portions of said sections, first gaps as said increased magnetic reluctance portions being formed between the bent portions of the long side sections on one hand and the bent portions of the short side sections on the other hand, second gaps as said corner portions being formed between the rest of long side sections and the rest of the short side sections.

7. A color picture tube according to claim 6, wherein said second gaps are shielded from the electron beams by the ends of the bent portions either the short or long side sections.

* * * * *